US007773920B2

(12) United States Patent
Oshikawa

(10) Patent No.: US 7,773,920 B2
(45) Date of Patent: Aug. 10, 2010

(54) TONER DROP SUPPRESSING DEVELOPING APPARATUS

(75) Inventor: Yuki Oshikawa, Yamato (JP)

(73) Assignee: Ricoh Co., Ltd., Tokyo (JP)

( * ) Notice: Subject to any disclaimer, the term of this patent is extended or adjusted under 35 U.S.C. 154(b) by 377 days.

(21) Appl. No.: 11/772,399

(22) Filed: Jul. 2, 2007

(65) Prior Publication Data

US 2008/0124136 A1 May 29, 2008

(30) Foreign Application Priority Data

Jul. 3, 2006 (JP) ..... 2006-183352

(51) Int. Cl.
*G03G 15/08* (2006.01)

(52) U.S. Cl. ..... 399/267

(58) Field of Classification Search ..... 399/252, 399/254, 267, 272, 274–277, 279, 281, 283, 399/284

See application file for complete search history.

(56) References Cited

U.S. PATENT DOCUMENTS 4,338,880 A * 7/1982 Tabuchi et al. ..... 399/103
4,705,383 A * 11/1987 Hiraga et al. ..... 399/275
4,791,882 A * 12/1988 Enoguchi et al. ..... 399/280
4,917,043 A * 4/1990 Yokoyama ..... 399/267
6,813,457 B2 * 11/2004 Yoshiki ..... 399/92

FOREIGN PATENT DOCUMENTS

JP 58066976 A * 4/1983
JP 03231777 A * 10/1991
JP 03239275 A * 10/1991
JP 08220858 A * 8/1996
JP 2001117349 A * 4/2001
JP 2005-201943 7/2005

OTHER PUBLICATIONS

U.S. Appl. No. 12,187,015, filed Aug. 6, 2008, Oshikawa, et al.
U.S. Appl. No. 12/238,815, filed Sep. 26, 2008, Utsunomiya, et al.
U.S. Appl. No. 12/042,848, filed Mar. 5, 2008, Kita, et al.
U.S. Appl. No. 12/059,392, filed Mar. 31, 2008, Takeyama, et al.
U.S. Appl. No. 12/246,027, filed Oct. 6, 2008, Uno, et al.
U.S. Appl. No. 12/253,538, filed Oct. 17, 2008, Uno, et al.
U.S. Appl. No. 12/138,802, filed Jun. 13, 2008, Uno, et al.

* cited by examiner

*Primary Examiner*—Robert Beatty
(74) *Attorney, Agent, or Firm*—Oblon, Spivak, McClelland, Maier & Neustadt, L.L.P.

(57) ABSTRACT

A developing apparatus includes a non-magnetic sleeve installing a magnetic field creating device, a developer carrier that carries and conveys developer including magnetic carrier and toner, and a development casing that contains developer. The development casing includes an opening that allows the developer carrier to be partially exposed and oppose a latent image carrier. The surface of the developer carrier vertically moves in the opening. An angle (θ) between an inner wall surface of the development casing, located in the vicinity of opening on the down stream side and the horizontal plane, meets the following relation, wherein μ represents a static friction coefficient of the inner wall surface in relation to the toner;

$$\sin\theta > \mu \times \cos\theta.$$

9 Claims, 6 Drawing Sheets

FIG. 6A

FIG. 6 FIG. 6A FIG. 6B

| EXPERIMENT NO. | INCLINATION ANGLE | CG | DEVELOPING APPARATUS INNER PRESSURE |
|---|---|---|---|
| ① | 30° | 1.3mm | 10Pa |
| ② | 45° | 1.3mm | 10Pa |
| ③ | 30° | 1.3mm | 10Pa |
| ④ | 45° | 2.3mm | 10Pa |
| ⑤ | 45° | 1.3mm | 0Pa |

FIG. 6B

| INSTALLING TAPE OR THE LIKE | AMOUNT OF TONER DROPPING | EFFECT |
|---|---|---|
| – | 100% | – |
| – | 22% | 78% DECREASE |
| TEFLON TAPE INSTALLATION | 23% | 77% DECREASE |
| – | 18% | 82% DECREASE |
| – | 20% | 80% DECREASE |

TONER DROP SUPPRESSING DEVELOPING APPARATUS

CROSS REFERENCE TO THE RELATED APPLICATION

This application claims priority under 35 USC §119 to Japanese Patent Application No. 2006-183352 filed on Jul. 3, 2006, the entire contents of which are hereby incorporating by reference.

BACKGROUND OF THE INVENTION

1. Field of the Invention

The present invention relates to an image forming system, such as a copier, a printer, a facsimile, etc., and in particular, to a developing apparatus and a process cartridge implemented in an image forming system and so on.

2. Discussion of the Background Art

Various ideas have been proposed to suppress drop of toner from a development casing in the developing apparatus of an image forming system. As one attempt among them, the Japanese Patent Application Laid Open No. 2005-201943 proposes a technology to suppress toner drop from a region between a developer thickness adjusting member located above an opening partially formed on a development casing and a developing region, in which the developer carrier opposes the photo-conductive member in a developing apparatus. The developing apparatus includes a developer carrier vertically moves in the opening while opposing a photo-conductive member through the opening.

According to such an attempt, since toner drop from the development casing in the vicinity of the opening on the upstream side in the developer carrier movement direction (i.e., above the opening) is suppressed, an interrupted image produced due to the toner drop in the developing region can likely be suppressed. Further, a stain of an image caused by adhesion of toner onto a transfer sheet fed below the developing region, and a problem of a sensor caused by adhesion of toner onto an intermediate transfer sheet, as well as a stain in a machine or the like can be suppressed.

However, such a conventional developing apparatus still needs some improvements, in particular, when two-component developer is utilized.

SUMMARY OF THE INVENTION

Accordingly, an object of the present invention is to improve such background arts technologies and provides a new and novel developing apparatus.

Such a new and a novel developing apparatus includes a non-magnetic sleeve installing a magnetic field creating device, a developer carrier that carries and conveys developer including magnetic carrier and toner, and a development casing that contains developer. The development casing includes an opening that allows the developer carrier to be partially exposed and oppose a latent image carrier. The surface of the developer carrier vertically moves in the opening. An angle ($\theta$) between an inner wall surface of the development casing, located in the vicinity of opening on the down stream side and the horizontal plane, meets the following relation, wherein $\mu$ represents a static friction coefficient of the inner wall surface in relation to the toner;

$$\sin\theta > \mu \times \cos\theta.$$

In another embodiment, a member having either smaller static friction coefficient in relation to the toner or less surface unevenness than an inner wall surface of the development casing, located in the vicinity of the opening on the downstream side, is attached to the inner wall.

In another embodiment, polarity of charging the magnetic carrier is positive, and the member attached to the inner wall surface includes a Teflon™ tape.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIGS. 6A and 6B collectively illustrate an exemplary table showing an exemplary result of toner drop experiment.

DESCRIPTION OF THE PREFERRED EMBODIMENTS

Figure 1B:
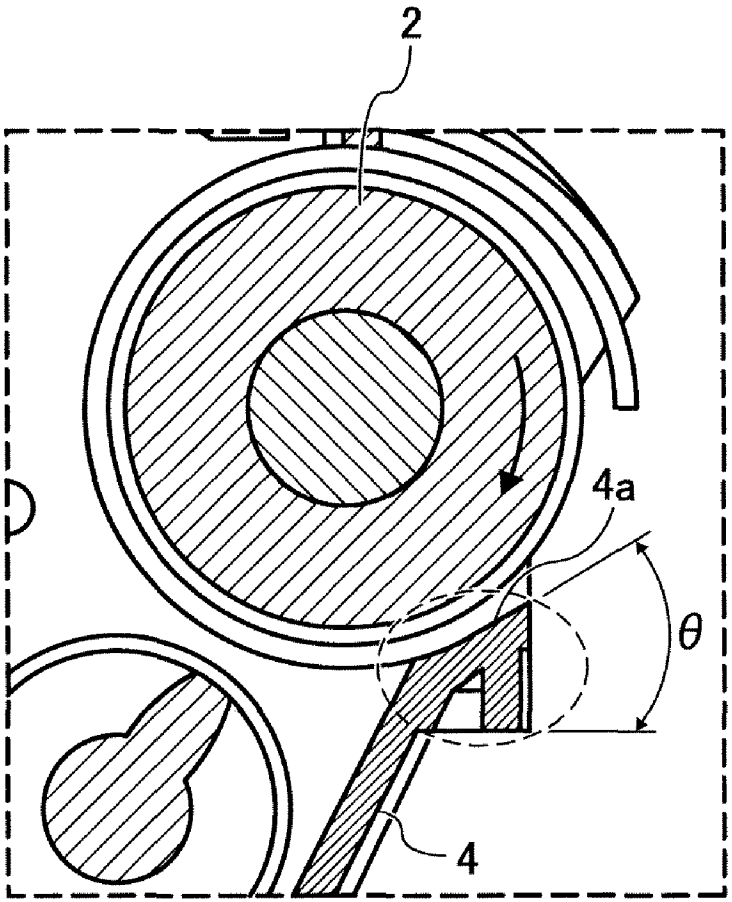
FIGS. 1A and 1B collectively illustrate a schematic configuration of an exemplary developing apparatus employed in an image forming system according to one embodiment of the present invention.
Figure 1A:
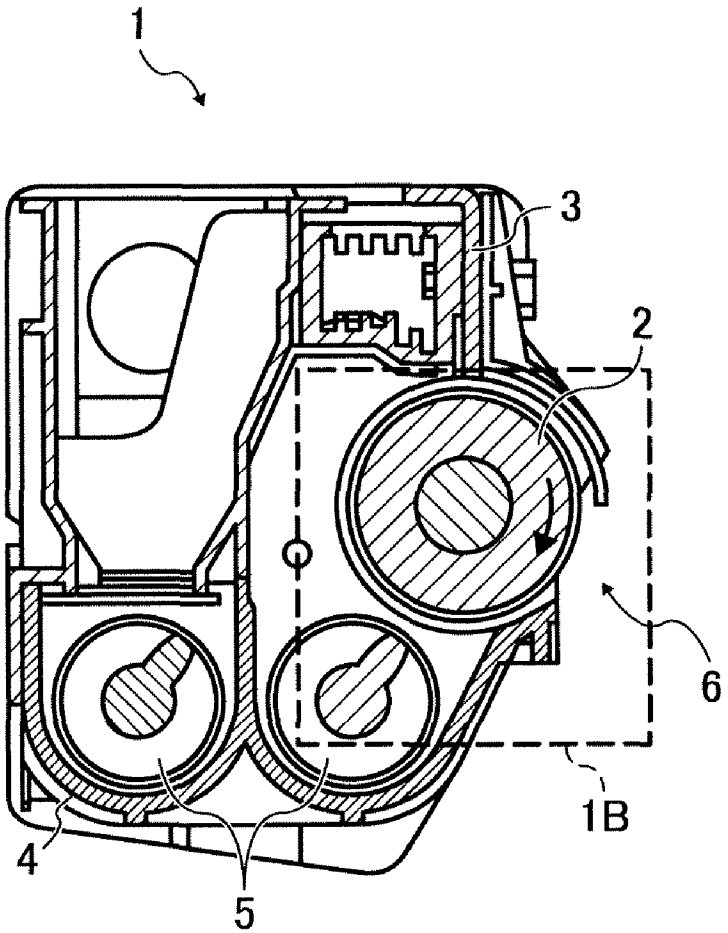

Referring now to the drawings, wherein like reference numerals designate identical or corresponding parts throughout several views, in particular in FIGS. 1A AND 1B, an image forming system includes a photo-conductive member as a latent image carrier, a charging apparatus, an exposure apparatus, a developing apparatus, a transfer apparatus, and a cleaning apparatus or the like each arranged around the photo-conductive member. These configurations and operations are executed using a general electro-photographic process.

The photo-conductive member, the charging apparatus, the developing apparatus, and the cleaning apparatus are integrated as a process cartridge to be detachable from the image forming system. The process cartridge can be withdrawn from the image forming system along a pair of guide rails, not shown, secured in the body of the image forming system. The process cartridge can be set to a prescribed position by inserting it into the apparatus body.

Now, an exemplary developing apparatus is described in detail with reference to FIGS. 1A AND 1B. The developing apparatus 1 utilizes two-component developer including magnetic carrier and toner. The magnetic carrier is charged with positive electricity and toner, with negative electricity, respectively. A development casing of the developing apparatus 1 includes an opening 6, and includes a developing sleeve 2 opposing a photoconductive member, not shown, through the opening 6. Also included is a development doctor 3 serving as a developer thickness-adjusting member that adjusts thickness, i.e., an amount, of developer carried on the developing sleeve 2. The developing sleeve 2 is made of nonmagnetic material, and is distanced from the photoconductive member to form a prescribed gap therebetween, while being rotated clockwise by a rotation driving mechanism, not shown. The developing sleeve 2 includes a magnetic roller serving as a magnetic field creating device for creating a magnetic field to carry and raise ears of the developer on the surface of the developing sleeve 2. The magnetic carrier, constituting the developer, ears up in a chain state on the developing sleeve 2 along a magnetic force line extending from the magnet roller. Further, toner charged with electricity adheres to the carrier now earring up in the chain state, thereby a magnetic brush is formed. The magnetic brush is then conveyed clockwise as the developing sleeve 2 rotates.

Figure 2:
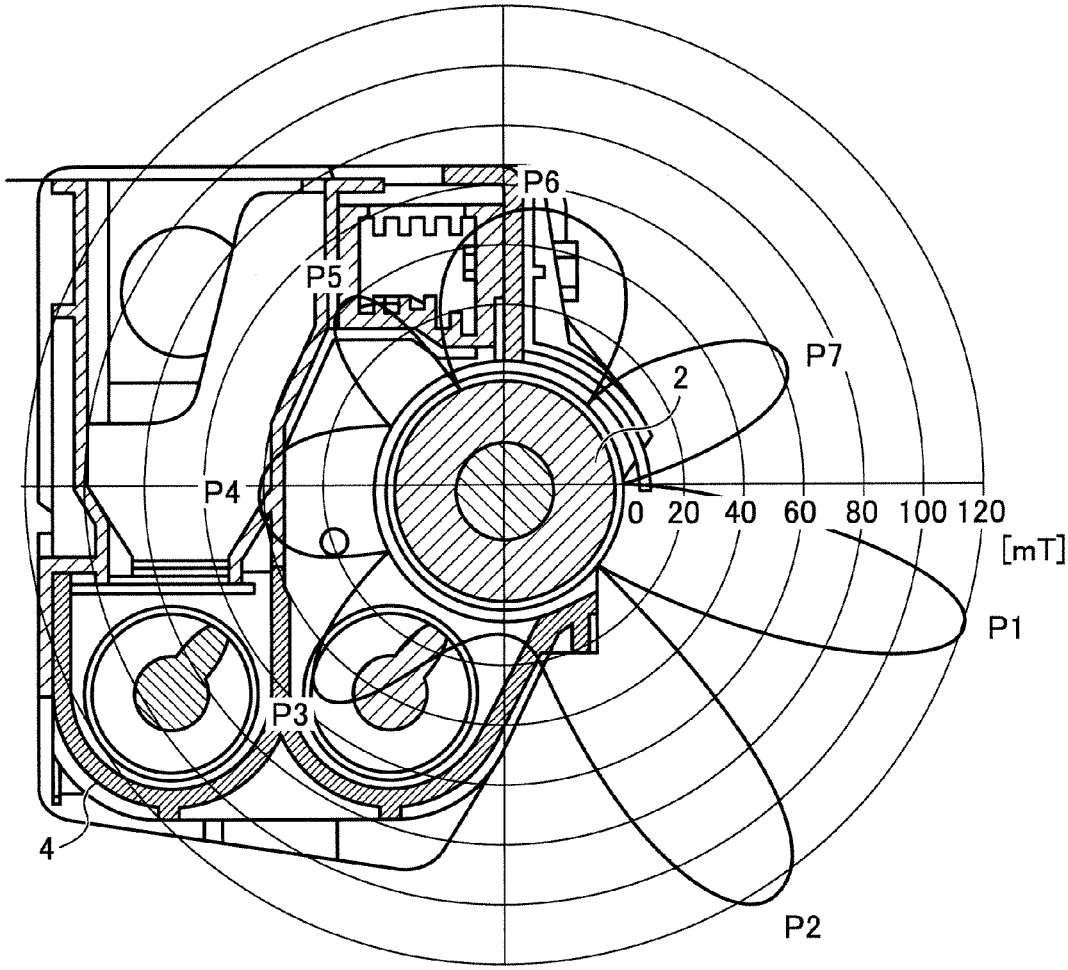
FIG. 2 illustrates an exemplary arrangement of a magnetic pole of the developing apparatus and a magnetic flux in normal line directions.

Now, an exemplary arrangements of magnetic poles of the magnet roller and a density of magnetic flux in a normal line is described with ref to FIG. 2. A pole set to cause a peak magnetic force directing to the center of the photoconductive member serves as a main pole (P1) in the magnet roller. Plural poles from P2 to P7 are arranged subsequent to P1 in this order in the rotational direction of the developing sleeve 2. As shown, a developer thin layer formed by the P1 pole on the developing sleeve 2 contacts the photoconductive member. Thus, toner of developer existing in the developing region is supplied for developing. Then, the developer is moved and returned back to the development casing 4 by means of the P2 pole as the developing sleeve 12 rotates. Magnetic repelling force of the P2 and P3 poles peels off the developer from the surface of the developing sleeve 2 and cause the developer to drop into the development casing.

As shown in FIGS. 1A AND 1B, a screw 5 is provided to serve as a developer stirring and conveying member in parallel to the developing sleeve 2. The screw constantly supplies the developer to the developing sleeve 2 by its rotation. Specifically, the screw stirs and mixes with fresh developer in the development casing 4 with the developer used and peeled from the developing sleeve 21 in the longitudinal direction during conveyance by its rotation. When the developer in the development casing is replenished with toner from a toner replenishing hole, not shown, the screw 5 stirs and conveys the replenished toner and the magnetic carrier while applying prescribed electric charge to the toner. Then, a new developer is carried and conveyed by the P4 pole, and is transferred to a developer doctor 3 that adjusts a developing layer thickness on the upstream side of the developing region by conveyance magnetic poles P5 and P6. Then, the new developer is made thinner on the developing sleeve 2 and is conveyed to the developing region by conveyance magnetic pole P7. The above-mentioned cycles are repeated.

Thus, the developer doctor 3 is arranged above the developing region while the downstream side of the developing region is located below the developing region. Since developer and accordingly charging performance of magnetic carrier deteriorate as time elapses in the developing apparatus 1, a ratio of insufficiently charged toner increases, and thereby the toner is easily separated from the magnetic brush. The toner separated from the magnetic brush tends to accumulate on an inner wall surface 4*a* (generally called "a jaw") of the development casing 4, adjacent to the opening 6 of FIGS. 1A and 1B on the downstream side of the developing sleeve moving direction. When the amount of the accumulation toner gradually increases on the inner wall surface 4*a*, the accumulation toner drops out of the development casing 4 from side ends of the inner wall surface 4*a*, thereby causing a problem. Then, an angle of the inner wall surface 4*a* in relation to the horizontal plane is adjusted so that the accumulated toner can drop within the development casing 4. A potential of the accumulated toner on the inclining inner wall surface 4*a* to move toward the development casing 4 is calculated by the following formula, wherein μ represents a static friction coefficient of the inner wall surface 4*a* in relation to the toner, theta represents an angle between the inner wall surface 4*a* and the horizontal plane, and G represents a gravity of the weight of accumulated toner;

$$G \times \sin\theta.$$

Then, the force $G \times \sin\theta$ is controlled to be not less than the static friction force $\mu \cdot G \cdot \cos\theta$ (i.e., $G \cdot \sin\theta > \mu \cdot G \cdot \cos\theta$).

Specifically, it is prevented by inclining the inner wall surface 4*a* and thus adjusting the angle θ to meet the following inequality that the accumulation toner on the inner wall surface 4*a* drops into the interior of the development casing 4 without leaking from the development casing 4 through the side end of the inner wall surface 4*a*.

Figure 3:
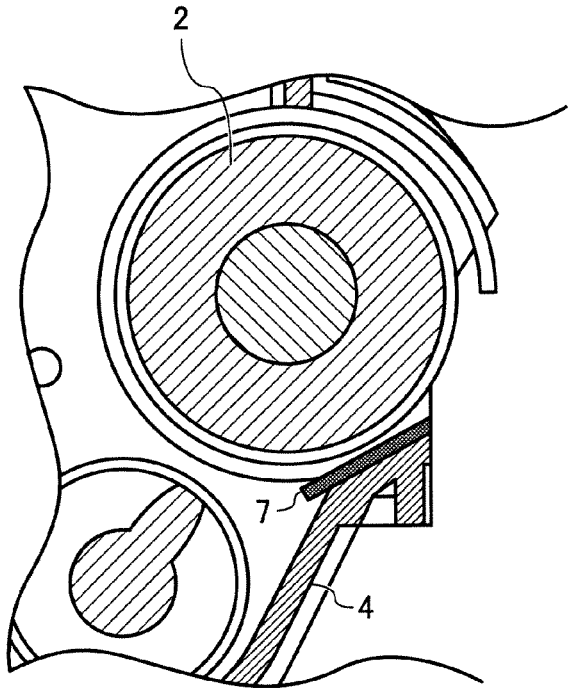
FIG. 3 illustrates an exemplary attachment position in which a low friction member is attached.

As shown in FIG. 3, a low friction member 7 having a smaller static friction coefficient than that (μ) of the inner wall surface 4*a* in relation to the toner can be adhered to the inner wall surface 4*a*. The development casing 4 is generally made of plastic, such as Poly-Carbonate (PC), ABS, etc. As a low friction member 7, a PET film or a Teflon (polytetrafluoroethylene) tape is exemplified. Otherwise, a smooth member having surface roughness less than the casing 4 can be adhered to the inner wall surface 4*a*. Thus, by adhering the member having the smaller friction coefficient or surface roughness onto the inner wall surface 4*a*, friction coefficient or surface roughness of the slant surface, on which toner accumulates, decreases and accordingly, the toner easily drops within the development casing 4 with its own weight. As a result, unfavorable toner drop can be suppressed.

Specifically, when the Teflon tape is adhered to the inner wall surface 4*a*, the magnetic carrier of the magnetic brush can be forcibly charged with positive electricity due to friction charge created when touching the Teflon tape of fluorine. Thus, the magnetic carrier can firmly attract toner, and as a result, the magnetic brush has a stronger electro-static binding force. Thus, the toner hardly parts from the magnetic brush, and accordingly, an amount of the toner accumulating onto the inner wall surface 4*a* decreases. As a result, toner drop is more reduced.

Figure 4:
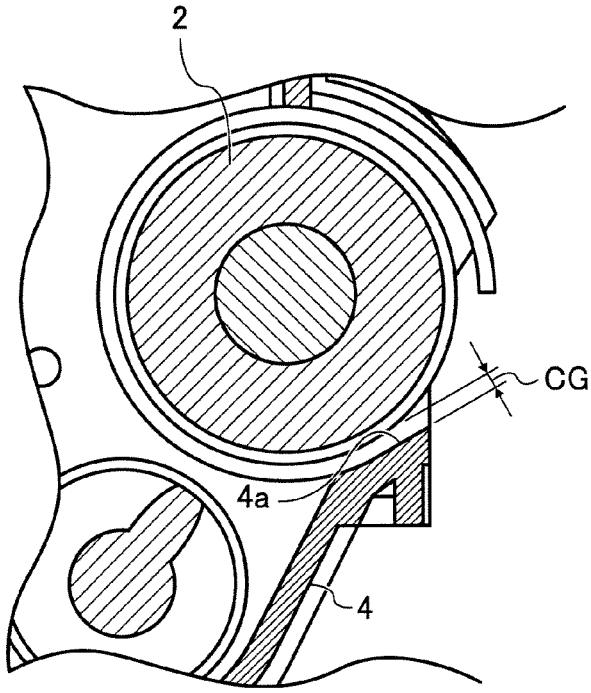
FIG. 4 illustrates an exemplary gap CG between a developing sleeve surface and an inner wall surface.
Figure 5A:
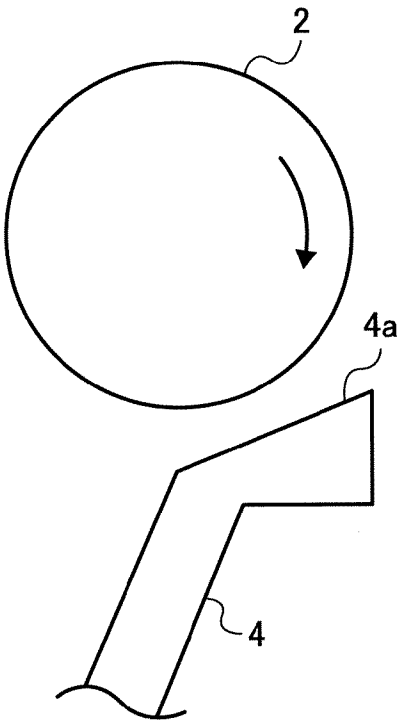
FIG. 5 illustrates an exemplary action of toner accumulating on an inner wall surface in a conventional developing apparatus.
Figure 5B:
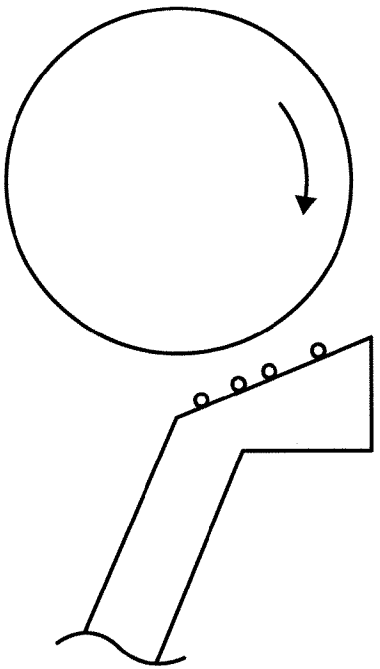
Figure 5C:
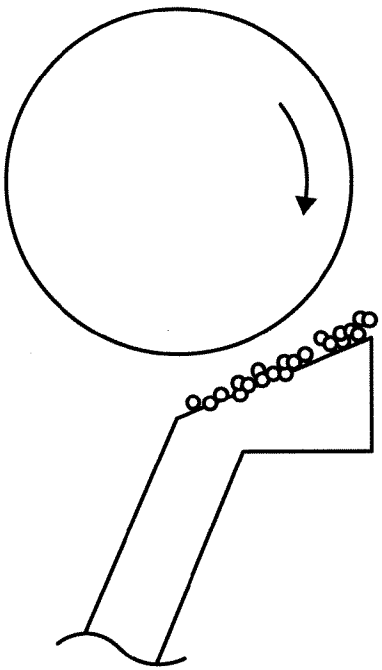
Figure 5D:
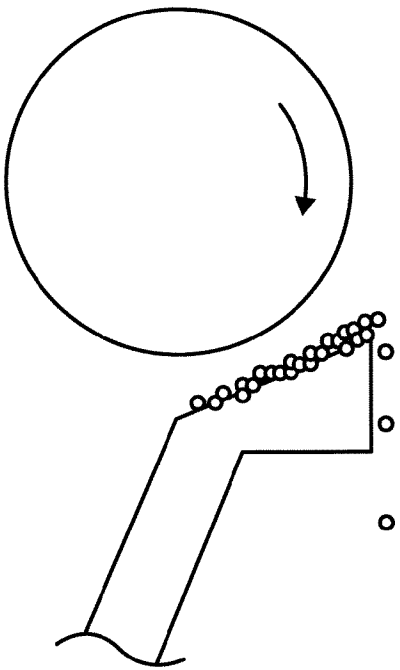

As shown in FIG. 2, a magnet pole P2 almost opposes the inner wall surface 4*a* of the development casing 4 at downstream of the developing region in the developing apparatus 1. Thus, the developing roller 2 causes the developer to ear up and form a magnetic brush opposing the inner wall surface 4*a*. The magnetic brush causes friction with the inner wall surface 4*a* and picks up the accumulation toner on the inner wall surface 4*a* in its rotational direction, thereby collecting those in the interior of the development casing 4. Thus, an amount of toner dropping and leaking from the inlet of the development casing 4 to an outside thereof can further be reduced. Further, it has been found out through the experiment of the inventor that a gap CG between the surface of the developing sleeve 2 and the inner wall surface 4*a* is preferably not less than 2 mm so that the magnet brush can pick up the toner within the development casing 4. FIG. 4 illustrates the gap CG between the surface of the developing sleeve 2 and the inner wall surface 4*a*. As shown there, when the gap CG is not more than 2 mm, a gap is too small for the developer to able to ear up sufficiently by means of the pole P2 and rather becomes a layer state around the developing sleeve 2, thereby passing through the gap. As a result, toner on the inner wall surface 4*a* is insufficiently picked up and remains thereon. When the gap is widen by increasing the gap CG to be not less than 2 mm, the larger ear of the magnet brush of the developer is created, and increasingly picks up the accumulation toner on the inner wall surface 4*a*, effectively. Thus, the toner drop can be suppressed.

Further, a pressure evacuation device, such a filter, an air pump, etc., can be employed in the development casing 4 for evacuating a pressure. Specifically, pressure in the development casing 4 is decreased using the pressure evacuation device so that a difference in pressure is created between the development casing 4 and the outside. The pressure difference creates a wind pressure and is applied to toner accumulating on the inner wall surface 4*a*, and accordingly, the toner readily drops within the development casing 4. Thus, the toner hardly accumulates on the inner wall surface 4*a*. As a result, toner drop can be reduced.

Herein below, various experiments are described, in each of which an effect of reduction of toner drop is confirmed. A table 1 collectively illustrated in FIGS. 6A and 6B1 represent results of measurement and comparison of amounts of toner drop, obtained by changing conditions, such as an inclination θ of the inner wall surface 4*a*, a gap CG between the surfaces of the developing sleeve 2 and the inner wall, usage of an inner pressure of a developing apparatus (an pressure evacuation member, usage of a low friction member adhered to the inner wall surface 4, etc. The amount of toner drop is practically measured on condition that solid black image formation is executed on 500 sheets of an A4 size (JIS) using two component-deteriorated developer. In the table 1, an experiment number 1 represents an experiment of a conventional developing apparatus, in which the pressure evacuation device is not used, the inclination θ is 30 degree, and the gap CG is 1.3 mm, and an inner pressure is 10 Pa. As shown there, a stain on an image, a sensor problem, and machine interior stain or the like are found due to toner drop from the inner wall surface 4*a*, specifically, an inlet of the development casing 4 below the opening. The amount of the toner drop in this condition serves as a reference, and thus is assigned 100%. In the experiment number 25, the inclination θ is set to 45 degree, and thus, the toner drop amount is largely decreased down to 22% of the experiment number 1. None of the image stain, the sensor problem, and the machine interior stain or the like reaches a serious level. When the inclination θ is 45 degree and the development casing 4 is made of the polycarbonate, the below described formula is met and toner accumulating on the inner wall surface 4*a* drops into the development casing 4. Thus, toner drop out of the development casing 4 from the end of the inlet of the development casing 4 can be suppressed. In the experiment number 3, a Teflon Tape having smaller static friction coefficient than Polycarbonate of the development casing 4 is adhered to the inner wall surface 4*a*, while keeping the inclination θ at 30 degree. As a result, the toner drop amount is significantly decreased down to 23% of the experiment number 1, and thus none of the image stain, the sensor problem, and the machine interior stain or the like reaches a serious level. In the experiment number 4, the gap CG is enlarged to be 2 mm while the inclination θ is 45 degree. As a result, the toner drop amount is more significantly decreased down to 18% of the experiment number 1 to be less than the experiment Number 2. In this way, by changing two conditions of the inclination of the inner wall surface 4*a* and the gap CG between the developing sleeve 2 surface and the inner wall surface 4*a*, the toner drop can be more efficiently reduced. Further, when the inclination of the inner wall surface 4*a* is set to 45 degree, while the developing apparatus inner pressure is decreased down to 0 Pa (Pascal) by arranging air pump in the development casing 4 as a pressure evacuator device in the experiment number 5, the toner drop amount is more decreased to be 20% of the experiment 1. In this way, by providing the pressure evacuating device in the development casing 4 in addition to the inclination of the inner wall surface 4*a*, the toner drop can more efficiently be reduced.

Numerous additional modifications and variations of the present invention are possible in light of the above teachings. It is therefore to be understood that within the scope of the appended claims, the present invention may be practiced otherwise that as specifically described herein.

What is claimed is:

1. A developing apparatus, including:

a developer carrier configured to carry and convey developer including magnetic carrier and toner, the developer carrier including a non-magnetic sleeve having a magnetic field creating device; and a development casing configured to contain developer, said development casing including an opening configured to allow the developer carrier to be partially exposed and oppose a latent image carrier, the surface of said developing carrier moving in an arc at the opening, and the opening facing at least in a horizontal direction;

wherein an angle (θ) between an inner wall surface of the development casing, located in the vicinity of opening on the down stream side, and the horizontal plane, meets the following relation, wherein μ represents a static friction coefficient of the inner wall surface in relation to the toner;

$$\sin\theta > \times\cos\theta.$$

2. The developing apparatus as claimed in claim 1, wherein said magnetic field creating device includes a magnetic pole opposing the inner wall surface, and wherein a gap between the surface of the developer carrier and the inner wall surface is not less than 2 mm.

3. The developing apparatus as claimed in claim 1, further comprising a depressor configured to depressurize the development casing.

4. A process cartridge detachably mounted to an image forming system, comprising:

a latent image carrier; and a cartridge developing device configured to develop a latent image formed on the latent image carrier, said cartridge developing device being integral with the latent image carrier; wherein said cartridge developing device includes a developing device having the same configuration as the developing apparatus as claimed in claim 1.

5. An image forming system, comprising:

a latent image carrier;

a latent image forming device configured to form a latent image on the latent image carrier; and a developing device configured to develop the latent image formed on the latent image carrier;

wherein said developing device includes the same configuration as the developing apparatus as claimed in claim 1.

6. A developing apparatus, including:

a developer carrier configured to carry and convey developer including magnetic carrier and toner, the developer carrier including a non-magnetic sleeve having a magnetic field creating device; and a development casing configured to contain developer, said development casing including an opening configured to allow the developer carrier to be partially exposed and oppose a latent image carrier, the surface of said developing carrier moving in an arc at the opening, and the opening facing at least in a horizontal direction, wherein a member including polytetrafluoroethylene having one of smaller static friction coefficient in relation to the toner than that of an inner wall surface of the development casing located in the vicinity of the opening on the downstream side and less surface unevenness than the inner wall surface is attached to the inner wall, and wherein an angle (θ) between the inner wall surface of the development casing, located in the vicinity of the opening on the downstream side, and the horizontal plane, meets the following relation, wherein μ represents a static friction coefficient of the inner wall surface in relation to the toner;

$$\sin\theta > \mu \times \cos\theta.$$

7. The developing apparatus as claimed in claim 6, wherein polarity of charging the magnetic carrier is positive, and the member attached to the inner wall surface includes a polytetrafluoroethylene tape.

8. The developing apparatus as claimed in claim 2, wherein said magnetic field creating device includes a magnetic pole opposing the inner wall surface, and wherein a gap between the surface of the developer carrier and the inner wall surface is not less than 2 mm.

9. The developing apparatus as claimed in claim 2, further comprising a depressor configured to depressurize the development casing.

* * * * *